US006524525B2

(12) United States Patent
Hauner et al.

(10) Patent No.: US 6,524,525 B2
(45) Date of Patent: Feb. 25, 2003

(54) METHOD FOR PRODUCING A CONTACT MATERIAL FOR CONTACT PIECES FOR VACUUM SWITCH DEVICES, AND A CONTACT MATERIAL AND CONTACT PIECES THEREFOR

(75) Inventors: Franz Hauner, Röttenbach (DE); Susett Rolle, Bonn (DE); Alfredo Lietz, Frechen (DE)

(73) Assignees: Metalor Technologies International SA, Neuchatel (CH); Moeller GmbH, Bonn (DE)

( * ) Notice: Subject to any disclaimer, the term of this patent is extended or adjusted under 35 U.S.C. 154(b) by 0 days.

(21) Appl. No.: 09/800,455

(22) Filed: Mar. 2, 2001

(65) Prior Publication Data

US 2001/0036418 A1 Nov. 1, 2001

(30) Foreign Application Priority Data

Mar. 4, 2000 (DE) ..... 100 10 723

(51) Int. Cl.[7] ..... B22F 3/26; C22C 1/04

(52) U.S. Cl. ..... 419/27; 419/28; 75/245; 75/247

(58) Field of Search ..... 419/28, 47, 27; 75/245, 247

(56) References Cited

U.S. PATENT DOCUMENTS 3,960,554 A * 6/1976 Gainer, Jr.
4,695,687 A * 9/1987 Grosse et al. ..... 200/144 B
4,780,582 A * 10/1988 Haessler et al. ..... 200/266
5,241,745 A * 9/1993 Kippenberg ..... 29/875

FOREIGN PATENT DOCUMENTS

| | | | |
|---|---|---|---|
| DE | 1 640 039 | * | 8/1971 |
| DE | 2 240 493 | * | 3/1974 |
| DE | 23 57 333 | * | 5/1975 |
| DE | 29 14 186 | * | 10/1979 |
| DE | 34 06 535 | | 9/1985 |
| EP | 144 846 | | 11/1984 |
| EP | 184 854 | | 12/1985 |
| EP | 172 411 | | 10/1988 |
| WO | 90/15424 | | 12/1990 |
| WO | 90/15425 | | 12/1990 |

* cited by examiner

*Primary Examiner*—Daniel J. Jenkins
(74) *Attorney, Agent, or Firm*—Pauley Petersen Kinne & Erickson

(57) ABSTRACT

A method for producing a contact material made of copper and chromium in a proportion of 40 to 75 wt.-% copper and 25 to 60 wt.-% of chromium for contact pieces for vacuum switch devices by pressing the powder mixture, sintering and infiltrating the compact and subsequent reshaping into a semi-finished contact material product having a density which corresponds to at least 99% of the theoretical density, as well as to contact pieces made of this semi-finished contact material product.

11 Claims, 2 Drawing Sheets

METHOD FOR PRODUCING A CONTACT MATERIAL FOR CONTACT PIECES FOR VACUUM SWITCH DEVICES, AND A CONTACT MATERIAL AND CONTACT PIECES THEREFOR

FIELD OF THE INVENTION

This invention relates to a method for producing a contact material made of copper and chromium in a proportion of 40 to 75 wt.-% copper and 25 to 60 wt.-% of chromium in the form of a semi-finished product, from which individual contact pieces are produced for use in vacuum switch devices. This invention also relates to contact materials in the form of semi-finished products for producing contact pieces for vacuum switch devices, as well as to contact pieces for vacuum switch devices.

BACKGROUND OF THE INVENTION

Contact pieces for use in vacuum switch devices, such as vacuum contactors, vacuum load disconnecting switches and vacuum circuit breakers for low voltage and intermediate high voltage, should be distinguished by low residual porosity, a low gas content, as well as high structural strength and high electrical conductivity. Moreover, the contact materials and contact pieces should be economical to produce.

The vacuum switch principle has gained worldwide acceptance for a considerable time in the high voltage range of voltages between 3 and 36 kV. The preponderant application relates to circuit breakers. Contactors up to a maximum of 12 kV are used to a lesser degree. The great dielectric stability of the vacuum switch and the completely emission-free switching, along with the further development of the production process and the accompanying reduction of costs make the vacuum switch principle also attractive for low-voltage devices. Contactors, circuit breakers and load disconnecting switches with nominal operation, or nominal currents and 100 to 1000 A, or 630 to 6300 A, at voltages up to 1000 (1500) V are mainly considered for this application of the vacuum switch principle.

The demands made on the above switch devices vary greatly. With vacuum circuit breakers for intermediate high voltage, the ability to switch off in case of a short circuit up to approximately 50 kA is preponderant. The number of operations at nominal current is around 30,000. But with a contactor, the number of operations of at least 500,000 are dominant. Moreover, no switch-off errors are permitted with a contactor, and it must be able to dependably switch off 10 to 12 times the nominal operating current and to switch on with separable weld spots, wherein the power of the drive mechanism is comparatively low. Although a vacuum contactor is not supposed to switch off a short circuit current, it must be capable, in particular in connection with low nominal operating currents, to conduct the current passed through the upstream connected fuse long enough until the fuse has interrupted the circuit. In this case the weld spots at the contact pieces must be separable.

But the vacuum circuit breaker for low voltage must have 2 to 3 times the capability of short circuit switch-off compared with circuit breakers for intermediate high voltage. Moreover, circuit breakers for low voltage are also used as motor switches, wherein no switch-off error is supposed to occur.

The load disconnecting switch, on the other hand, must be capable to switch on currents up to 20 times the nominal current. The weld spot on the contact pieces occurring during this must be separable by the drive mechanism.

Contact materials, or contact pieces, for vacuum switches on the basis of chromium and copper are known and are produced in various forms from meltable materials or in accordance with metal powder processes or sintering and infiltration methods.

A CuCr contact material for vacuum switches is known from German Patent Reference DE-OS 16 40 039, which consists of a sintered metal matrix of chromium, which is infiltrated with an infiltration substance made of copper. German Patent References DE 23 57 333 A1 and DE 25 21 504 A1 describe a sintered metal matrix as the contact material for vacuum switches, wherein aluminum or tin is added as embrittling aid to the main component, for example chromium, and this metal matrix is infiltrated with an infiltration substance made of copper, silver or alloys of these metals. Here, the sintering temperatures lie above 1200° C., while the melting temperature of the infiltration substance lies below the respective sintering temperature. Contact materials of the size and shape of the individual contact pieces are preferably produced with the above mentioned process.

A contact material for vacuum switches is also described in German Patent Reference DE 22 40 493 A1, which has a sintered metal matrix made of a metallic main component with a melting point above 1600° C. and a metallic side component with a melting point above the melting point of an infiltration substance, wherein the sintered metal matrix is impregnated with copper as the infiltration substance, for example.

A process for producing chromium-copper contact pieces for vacuum switches is known from U.S. Pat. No. 3,960,554, having a chromium content of 40 to 60 wt.-%, wherein in a first step the desired amount of chromium powder for the finished contact piece is mixed with a very small amount of copper powder and a compact is thus produced, which is subsequently sintered for producing a porous chromium matrix, which thereafter is infiltrated with a large amount of copper while sintering is continued until the chromium matrix is filled with copper in the desired proportion of 60 to 40 wt.-% Cu and 40 to 60 wt.-% Cr. This process initially operates with less than 10 wt.-% of copper powder for producing the sinter matrix, and the larger proportion of copper powder of at least 30 to 50 wt.-% is inserted exclusively by subsequent infiltration into the chromium sinter matrix.

The sintering processes for producing individual copper-chromium contact materials have the disadvantage that, because of the introduction of the entire amount of copper, or almost the entire amount of copper, in a liquid phase, namely by infiltration into the chromium sinter matrix, compacts of clearly increased size are created, which accordingly must be later worked by machining for obtaining the final shape of the desired contact piece.

A further method for producing individual contact pieces is a powder-metallurgical method, wherein a powdery mixture of the component with a high melting point, such as chromium, and of the component with a low melting point, such as copper, are pressed to form a blank, and the blank is subsequently sintered and the sinter body is further pressed, either cold or warm, for the purpose of compressing it, such as described, for example, in German Patent Reference DE 29 14 186 A, German Patent Reference DE 34 06 535 A1 and European Patent Reference EP 0 184 854 A2. With this method, the concentration of the components can be selected within a wide range, and the shape of the blanks almost corresponds to the final shape of the contact pieces. Extensive systems of hollow spaces, such as can occur in connection with inferior infiltration materials, do not appear, but such sinter materials have a residual porosity and a density, which usually is removed by at least 2% from the theoretical density of 100% and which has disadvantageous effects when used as a contact material for contact pieces for vacuum switch tubes. Thus, the efficiency of the pure sinter materials is limited.

To reduce the porosity of contact pieces made by powder metallurgy on the basis of copper and chromium for vacuum switch tubes, a two-stage method for compressing the powder compact is proposed by International Application PCT/DE89/00343, wherein powder compacts are sintered in a high vacuum, and wherein thereafter the sinter bodies are subjected to hot isostatic pressing at temperatures below the melting point of copper in a protective gas atmosphere at pressures between 200 and 2000 bar. With this very expensive process it is possible to still further reduce the porosity of the finished product and to achieve approximately 99% of the theoretical density.

A melting material of copper and chromium for contact pieces of vacuum switches is suggested by European Patent Reference EP 0 172 411 B1, wherein a compact is produced from a powder mixture of chromium and copper by means of isostatic pressing at high pressures of 3000 bar, which is subsequently sintered in a vacuum at temperatures close to or above the melting point of copper. The blank thus produced is inserted as the consumable electrode in an arc furnace and is refined in a helium atmosphere as the protective gas. The electrode material melted off is solidified in a water-cooled copper mold, and the melt block thus created by arc melting is subsequently formed into a semi-finished product for contact pieces by full forward extrusion, wherein shaping degrees of more than 60%, for example 78%, are applied. This semi-finished product has a straightened structure, wherein the very fine chromium dentrites, created in the course of cooling in the copper mold following refinement, are present in a line-like orientation in preferred directions. Disks for contact pieces are cut from the refined blank, wherein a switching surface of the contact pieces perpendicularly with respect to the present straightened structure results. The copper-chromium workpieces thus produced by means of this method are extremely elaborate and expensive because of the multi-stage method used and the required amounts of energy for the arc melting.

A more economical method for producing copper-chromium contact materials for contact pieces of vacuum switches with a lesser amount of residual porosity is proposed in International Application PCT/DE89/00344, wherein in a first step a powder mixture is prepared from powders of the components and a compact is made, which thereafter is sintered and, for improving the final compacting, is subjected to an upsetting process or a cold extrusion process at a minimum shaping degree of 40%, wherein a volume ratio of at least 99% of the theoretical density is intended to be achieved. Bonding of the copper and chromium components is achieved by cold-welding the structural components, wherein chromium powder with relatively narrow particle size distributions below 63 $\mu$m is preferred. In the sinter body these chromium particles are only partially connected by sinter bridges, so that, although they are stretched in a preferred direction by the reshaping, they do not form a sufficiently continuous matrix, and the bonding quality between copper and chromium, and therefore the switching properties, are in need of improvement.

SUMMARY OF THE INVENTION

One object of this invention is to provide an economical method for producing contact materials for vacuum switch devices, by which contact materials are created which meet the most stringent requirements, in particular, improving their melting loss behavior and useful life, and which have a very low residual porosity and achieve a density of at least 99% of the theoretical density.

In accordance with this invention, for attaining the stated object a method is proposed for producing a contact material in the form of a semi-finished product made of copper and chromium in a proportion of 40 to 75 wt.-% of copper and 25 to 60 wt.-% of chromium, containing the following method steps.

Chromium powder in an amount corresponding to the chromium content of the contact material to be produced, or a mixture of chromium powder in an amount corresponding to the chromium content of the contact material to be produced and of copper powder in an amount which is less by 5 to 15 wt.-% with respect to the copper content of the contact material to be produced is pressed, using pressures between 200 and 1000 MPa, into a porous compact having a density corresponding to 75 to 90% of the theoretical density.

The porous compact is covered with an amount of copper which at least corresponds to the copper amount missing from the contact material to be produced.

Thereafter, the compact covered with copper is heated in a high vacuum to a temperature up to or beyond the melting point of copper, wherein the compact is sintered, forming a chromium matrix sinter body or a copper-chromium matrix sinter body, and the chromium matrix sinter bodies or copper-chromium matrix sinter bodies created are simultaneously infiltrated by the liquefied copper covering the compact.

A copper-infiltrated chromium sinter body, or a copper-infiltrated copper-chromium sinter body is obtained, which has a copper content which is increased in comparison with the compact and has a density corresponding to 96 to 98% of the theoretical density.

The obtained copper-infiltrated chromium sinter body, or copper-infiltrated copper-chromium sinter body is subsequently formed into a semi-finished product constituting the contact material by extrusion in one stretching direction, wherein the chromium grains in the sinter bodies are pulled out in the stretching direction to form chromium columns and constitute an elongated straightened structure, and wherein the shaping degree of the sinter bodies is at least 30%.

A semi-finished contact material product is obtained, which has a straightened structure and a density, which corresponds to at least 99%, in particular 99.5 to 99.9% of the theoretical density.

Advantageous further developments of the method of this invention are discussed in the following specification and in the claims.

In accordance with this invention, a contact material made of copper and chromium, capable of high performance, is created in a multi-stage process, namely the production of a porous chromium powder compact or copper-chromium powder compact, which has a reduced amount of copper in the compact, compared with the desired final composition of the end product.

Subsequent production of a chromium matrix or of a copper-chromium matrix by sintering in a high vacuum and simultaneous infiltration of the matrix with additional copper, by which a dense sinter body is obtained, and a following further mechanical compression of the sinter body infiltrated with copper with simultaneous reshaping and stretching the same in one direction, by which a contact material in the form of a semi-finished product is obtained which, because of the reshaping, has a straightened structure made of chromium and copper in the form of chromium columns embedded in elongated copper tracks, as well as a density which is again increased in comparison with the infiltrated sinter body and almost corresponds to the theoretical density.

The employment of extremely pure, electrolytically obtained chromium powder of a degree of purity of at least 99.8%, with very low gas contents, in particular oxygen and nitrogen each less than 200 ppm, and very low Fe and Al contents, also each less than 200 ppm, is essential for achieving a high compression of the copper-infiltrated sinter body and the straightened structure. Surprisingly, such extremely pure chromium in the form of a sinter body can be easily reshaped, so that the semi-finished contact material product with a straightened structure is obtained.

Reshaping of the copper-infiltrated chromium sinter body, or copper-chromium sinter body, can be performed by extrusion or forging or rolling, respectively in one direction.

To achieve a sturdy structure, also by the subsequent reshaping of the infiltrated sinter body, chromium powder of a grain size greater than 50 $\mu$m and up to approximately 160 $\mu$m is preferably used, a mixed grain size is particularly preferred.

For the sintering and infiltration process of the porous compact made of chromium powder, or copper-chromium powder, the missing amount of copper for the desired final composition of the contact material or, if desired, slightly more, for example in the form of compact copper, is packed on and/or under the compact and is subjected, together with the latter, to the sintering process. The sintering process is preferably performed in a high vacuum at pressures of less than $10^{31\ 4}$ mbar with continuous heating of the compact at least to a temperature at which the copper melts wherein, on the one hand, some copper-chromium alloy is formed because of the sintering, and furthermore the copper-chromium matrix, or chromium matrix, being formed is infiltrated by the additional solid copper. The compact is compressed by means of the sintering and infiltration process to a density of more than 99% of the theoretical density, wherein at the same time the original composition of the compact made of chromium, or copper and chromium, is also changed into the desired composition of the amount of copper and chromium by increasing the copper content, and the desired final composition is achieved. The copper-infiltrated chromium sinter body, or copper-infiltrated copper-chromium sinter body, has great density, a very solid structure and high ductility. The latter is also achieved by using extremely pure chromium, namely an electrolytically obtained chromium powder.

The contact material has an excellent bond between the components copper and chromium because of the liquid phase during infiltration. The contact material produced in accordance with this invention is a powder-metallurgical material, which has a straightened structure because of the reshaping of the sinter body.

In accordance with this invention, a powder-metallurgical material in the form of a semi-finished product for contact pieces for vacuum switch devices is proposed, which is made of copper and chromium in a proportion of 40 to 75 wt.-% of copper and 25 to 60 wt.-% of chromium, which is obtained by producing a compact made from a powder mixture, sintering and additional infiltration of the compact with copper in a continuous process and subsequent reshaping of the copper-infiltrated sinter body which, because of the reshaping in one direction, has a straightened structure with elongated chromium columns, which are embedded in elongated copper tracks, and which has a density of at least 99%, in particular more than 99.4%, of the theoretical density, and whose electrical conductivity and tensile strength parallel with the stretching direction is at least 10% greater than perpendicularly with respect to the stretching direction. A preferred powder-metallurgical material, capable of high performance, in accordance with this invention has a content of 55 to 62 wt.-% of copper, a shaping degree of at least 70% and an electrical conductivity parallel with the stretching direction which lies around 45% of the electrical conductivity of pure copper, and has a tensile strength in the stretching direction of at least 550 N/mm$^2$.

Contact pieces in accordance with this invention for vacuum switch devices made of a powder-metallurgical material of copper and chromium in a proportion of 40 to 75 wt.-% of copper and 25 to 60 wt.-% of chromium, which is produced by fabricating a semi-finished product, are distinguished by a copper-infiltrated sinter body with a chromium matrix, or a copper-chromium matrix, which has been reshaped cold or warm in one stretching direction by at least 30% and has a density corresponding to at least 99%, in particular greater than 99.4%, of the theoretical density, whose contact surface is formed transversely with respect to the stretching direction, and whose tensile strength and electrical conductivity parallel with the stretching direction are respectively greater by at least 10% than transversely to the stretching direction.

Contact pieces in accordance with this invention for vacuum switch devices are produced by fabricating the semi-finished contact material product in accordance with this invention, wherein the contact surfaces of the contact pieces are formed perpendicular with respect to the stretching direction of the semi-finished contact material product. The infiltrated sinter bodies are usually obtained in the form of bars, so that a semi-finished product in the form of a rod is obtained by stretching in one direction and reshaping.

It was found that best results are obtained when employing extremely pure, electrolytically obtained chromium powder, electrolyte chromium. Although electrolyte chromium does have thin chromium oxide skins on the surface of the powder grains, these do not remain on the chromium particles during the manufacturing process of the CuCr contact material, but instead are infiltrated by liquid copper during the sinter infiltration process and are separated from the chromium particles. Thus, the copper can be alloyed to the chromium during the sinter infiltration process and can lead to a solid bond between the two phases. The very pure, and therefore very ductile, electrolyte chromium is reshaped into chromium columns by the reshaping process, as a result of which the proportion of the interface between the copper and the chromium on the contact surface, i.e. perpendicularly in relation to the switching surface of the contacts, is greater by a multiple than parallel with the switching surface.

The contact material in accordance with this invention and the contact pieces produced from it are suitable for meeting the requirements of vacuum switch devices, they are particularly distinguished by:

high resistance to melting loss;

long useful electrical life;

great dielectric stability because of homogeneously closed switching texture and even consumption;

continued electrical conductivity over the entire useful life;

an extremely thin, closed switching texture layer forming at the contact surface;

high density with negligible gas pockets;

economical manufacture; and great thermal and electrical conductivity.

A switching texture layer forms on the entire contact surface of the contact pieces during the useful electrical life of a vacuum switch device. Since the current on both sides must first pass through this switching texture layer, the switching texture layer has a great effect on the current transmission and the useful life of the vacuum switch device. The contact resistance of the switching texture layer is considerably greater than that of the copper-chromium contact material. A melt of copper-chromium forms with each switching operation, and following solidification there is a more or less fine structure of mixed crystals rich in copper or chromium, depending on the cooling speed of the switching texture layer. This textural structure of the switching texture layer affects the thermal and electrical conductivity, as well as the hardness. The formation of a particularly advantageous switching texture layer with a high stability of the texture is achieved by means of the contact material of this invention.

During the useful electrical life, the contact material in accordance with this invention forms a thin and level switching texture layer on the surface of the contact pieces, which is completely bonded to the contact material and adheres to it. A damaging crack formation is thus prevented, both inside the contact piece and in the area of the switching texture on the surface. The electrical and the thermal conductivity are great because of the thin and completely adhering layer on the surface, which is formed as a switching texture layer as a result of switching. This thin layer leads to rapid cooling, and therefore reduced welding tendency, as well as reduced thermal heating because of the flow of electricity. Consumption of the contact material in accordance with this invention as a result of switching is low because of the formation of this thin barrier layer on the surface of the contact pieces, which has a long useful life as a result.

With tensile stress perpendicularly to the switching surface, the contact material has great stability, so that the separation when opening the contact pieces following first switching preferably takes place at the weld point, or that only negligible breaks in the contact material occur.

The contact material in accordance with this invention can be preponderantly employed in vacuum switch devices, or vacuum switch tubes, for low and intermediate high voltage.

The essential improvement of the copper-infiltrated chromium, or copper-chromium sinter body is achieved by means of the definite reshaping, wherein shaping degrees are preferably greater than 50% and wherein reshaping is performed in such a way that the sinter matrix is stretched in one direction, because of which the chromium powder grains become elongated columns, and the copper is reshaped into elongated copper tracks. In this way the stability is considerably increased in the stretching direction, one the one hand, and on the other hand conductivity, in particular electrical conductivity, is considerably improved in the stretching direction. A powder-metallurgical contact material with a straightened structure is obtained.

In accordance with this invention, reshaping of the sinter bodies is performed in such a way that elongated chromium columns or chromium fibers are reduced to up to ten times the original diameter of the chromium grains. The contact surface of the contact pieces is formed by fabricating contact pieces transversely to the stretching direction of the semi-finished contact piece product. The contact surface of the contact piece has fine points of chromium distributed in the copper in accordance with the fine chromium columns of the stretched chromium sinter structure, which is a prerequisite for good contact and makes possible the subsequent formation of a very thin switching texture layer in the range of 100 $\mu$m.

The adhesion of the thin switching texture layer to the basic structure of the contact material is comparatively good. The thin switching texture layer leads to very good heat dissipation into the contact material. The distinctive stretched texture structure of the contact material is primarily responsible for this thin switching texture layer. By means of this stretched texture structure, at 27 Sm/m conductivity increased by 30% is achieved in the vertical direction with respect to the contact and switching surface over a direction parallel with the contact and switching surface.

The electrical current flows without obstacles (pores or cracks), and therefore at a homogeneous current density on the direct path from the switching texture layer into the contact material, where it can flow almost unhampered along the copper tracks.

Consumption at this contact surface is low because of the switching texture layer acting as a barrier layer, which leads to a clear increase in the useful life.

In the stretching direction, electrical conductivity can be 30% and more greater than perpendicularly thereto, the tensile strength in the stretching direction can also be increased by 30% or more in comparison with the transverse direction as a function of the shaping degree and the copper content.

The embodiment of the surface of the contact material of the contact piece with fine chromium points embedded in copper allows even consumption and thus a long useful life of the contact piece. This surface of the contact piece, which starts to melt during each switching process, does not dissipate heat well, however, in accordance with this invention, satisfactory heat dissipation is achieved by means of the directional structure of the contact material.

The semi-finished contact material product produced by reshaping of the copper-infiltrated sinter body can be shaped in the desired manner with a preferred direction for forming an appropriate structure by cold or warm extrusion, cold or warm forging, or cold or warm rolling. The contact pieces can be obtained in the desired shape from this shaped semi-finished contact material product by machining. Preferably, disks of the desired thickness are cut transversely to the stretching direction from the semi-finished contact material product, for example bars, and are brought into the desired final shape of the contact pieces for the vacuum switch devices either by machining or by cold or warm stamping.

The infiltration process by means of a small residual amount of copper, simultaneously with the sintering process, of the chromium sinter body, or the copper-chromium sinter body, is used for removing possible residual porosity and for a good bonding by means of the liquid phase of the copper used for infiltration.

BRIEF DESCRIPTION OF THE DRAWINGS

This invention is explained by the use of metallographic representations.

DETAILED DESCRIPTION

Figure 1:
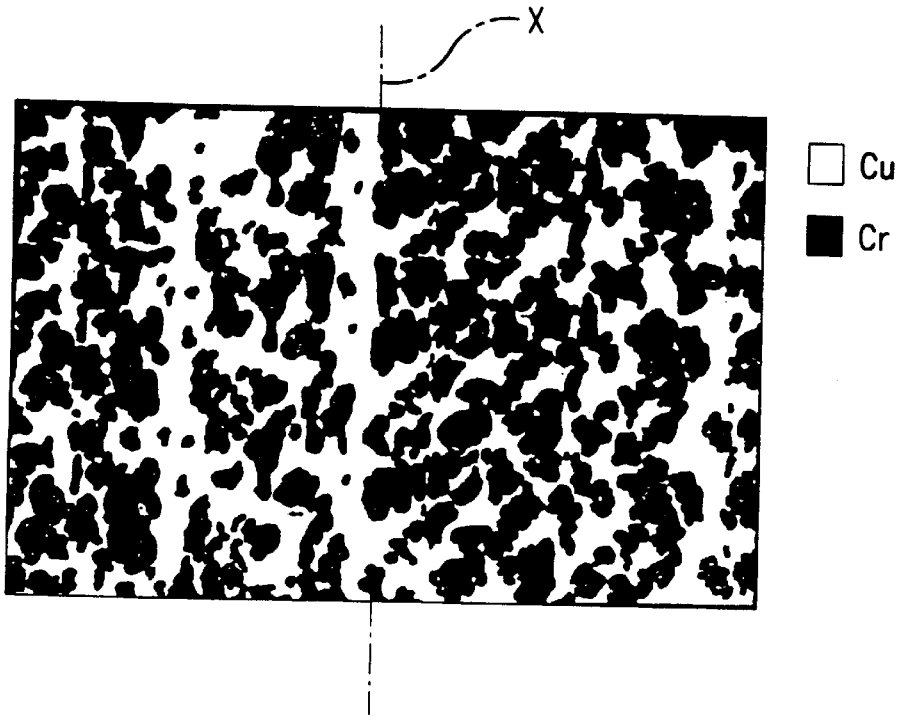
FIG. 1 represents a cut face of a copper-infiltrated sinter body parallel with the subsequent stretching direction X.

A section, enlarged 50 times, through a copper-infiltrated copper-chromium sinter body in a bar shape, which has not yet been reshaped, and of a composition containing 40 wt.-% of chromium and 60 wt.-% of copper, is represented in FIG. 1, parallel with an axis X.

The sinter matrix with chromium powder grains, which are essentially still grainy or baked together in grainy form, in the melted open copper areas, can be seen.

Figure 2:
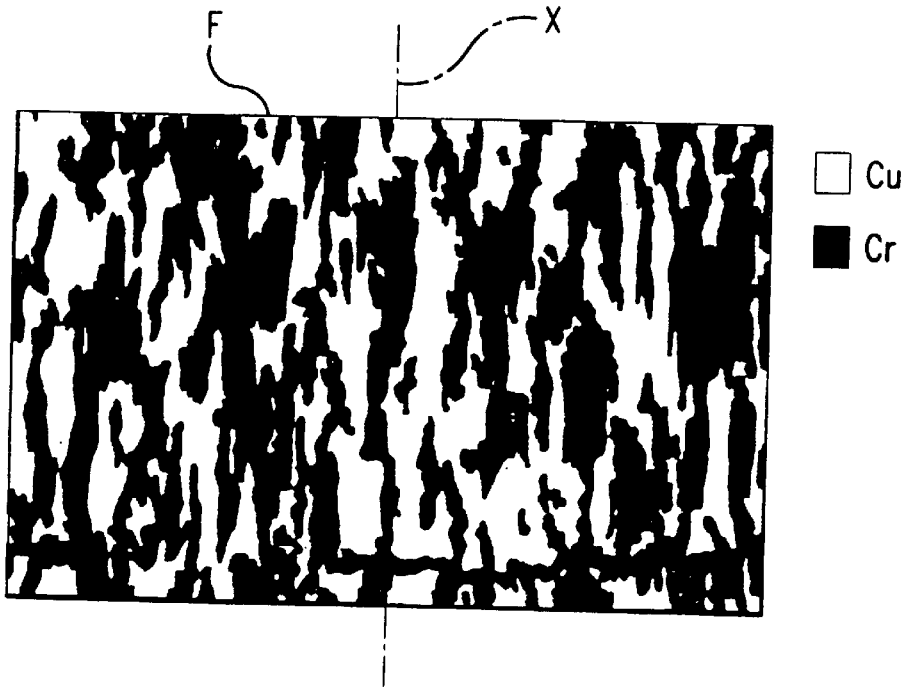
FIG. 2 represents the cut face of the semi-finished contact material product manufactured by reshaping the sinter body in accordance with FIG. 1 parallel with the stretching direction X.

A representation of the copper-infiltrated copper-chromium sinter body in accordance with FIG. 1 after cold shaping by extrusion with a shaping degree between 75 and 80%, is represented in FIG. 2. The representation shows a section parallel with the stretching direction X, i.e. the extrusion direction, amplified 50 times. It becomes clear that an elongated structure of the sinter matrix is obtained by reshaping, stretching of the chromium grains into long chromium columns, which are embedded between elongated copper tracks, takes place in particular, because of which the surface F, which later is used as contact surface of the contact pieces and extends transversely to the stretching direction X, is provided with a structure which makes possible the formation of a switching texture layer, which has a positive effect on the switching behavior and the useful life.

This contact material has a defined directional structure, see FIG. 2, with columnar crystals of chromium in a matrix made of copper. The columnar crystals are arranged parallel with the extrusion direction X, and are therefore perpendicular to the switching surface F. They are of a length of up to 2 mm and a diameter of up to 60 $\mu$m.

Figure 3:
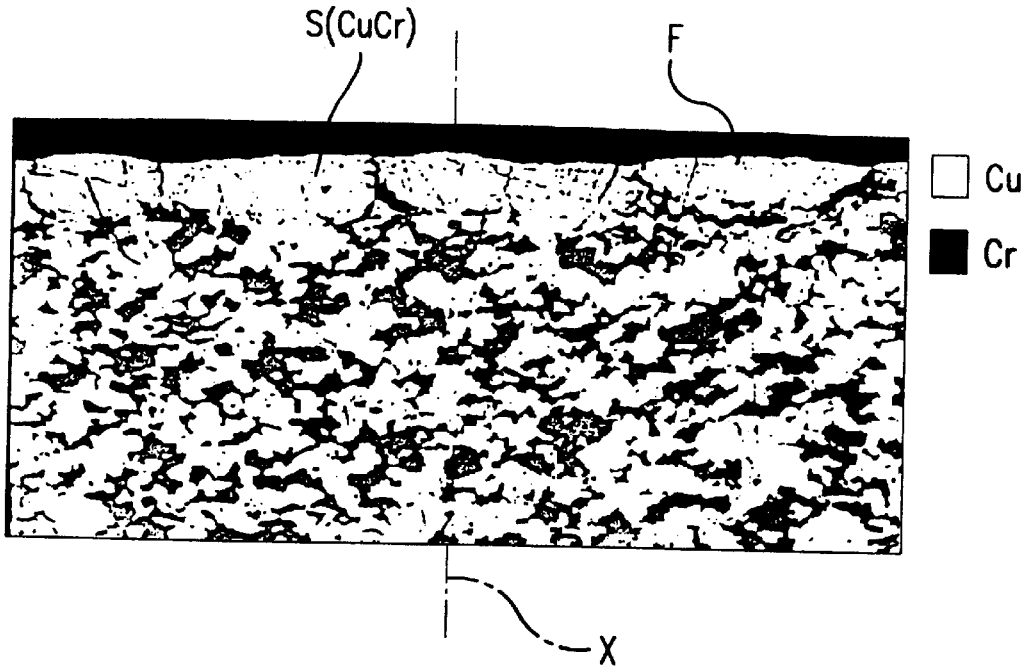
FIG. 3 represents a copper-chromium sinter body with a switching texture layer formed on it.
Figure 4:
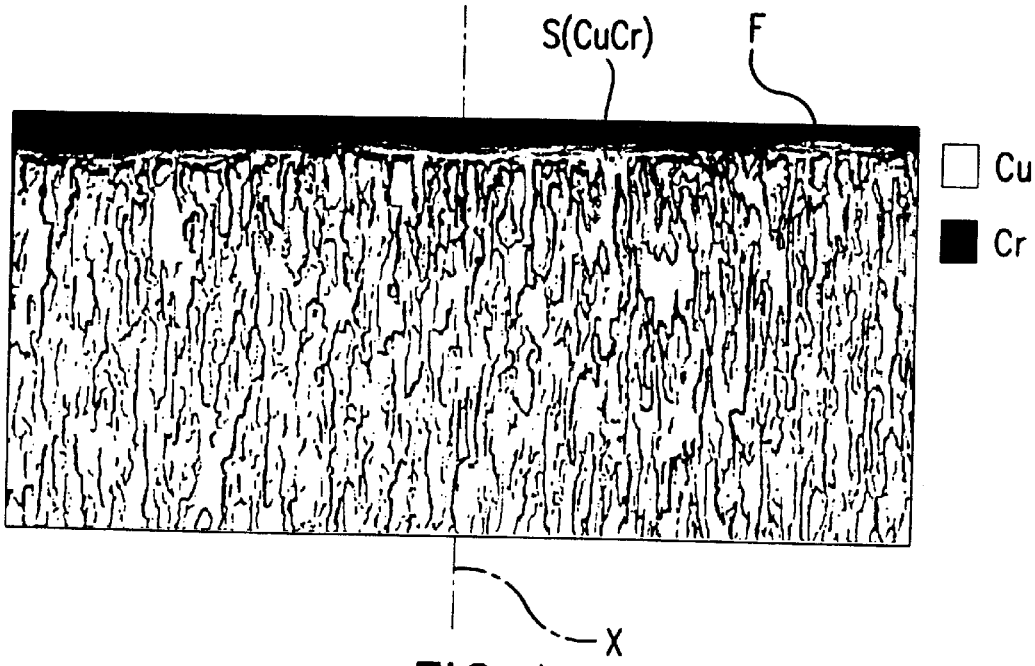
FIG. 4 represents the contact material in accordance with FIG. 2 with a switching texture layer formed on it.

Switching in the new state of the contact pieces under extremely high stresses has a decisive effect on the formation of faults on the surface F of the contact pieces, and therefore on the further switching behavior of the contacts. Arcs, or extremely high current densities at a small contact surface, followed by strong heating up to the start of melting, can lead to the partial welding together of the contact surfaces of the contact pieces. The formation of a switching texture layer on the contact surface occurs in the course of welding together. Depending on the energy and cooling speed, this switching texture layer is a more or less homogeneous mixture of copper and chromium up to an alloy. In the course of switching off without current, sufficiently strong mechanical shearing and tensile forces lead to the breaking open of the welded-together area, and weld spots then become macroscopically visible. With a contact piece produced from a copper-chromium sinter body with a CuCr distribution of 60/40 and with chromium grains of electrolytic chromium distributed isotropically almost spherically, metallographic tests, see FIG. 3, show that a switching texture layer S of approximately 0.4 mm thickness is formed which, however, is still cracked in many places vertically to the surface as far down as the original contact material. Thus the adhesion between the switching texture layer and the contact material is disrupted, and broken off particles can lead to switch-off errors in the course of switching. But with reshaped copper-chromium materials with column-shaped chromium particles in accordance with this invention, see FIG. 2, which extend perpendicular with respect to the contact surface F, a flat, very thin switching texture layer S, see FIG. 4, of a thickness of only 0.1 mm is formed. This switching texture layer is ductile and adheres completely to the contact material without the formation of cracks and pores. It shows a different breaking image, because the tensile strength of a chromium-copper contact piece in accordance with FIG. 2 is considerably greater, up to 30% and more, along the chromium columns than perpendicularly thereto. Accordingly, when the restoring force of the device is greater than the strength of the welded-together part is required, the contacts break open directly at the contact surface parallel with the welded-together part, and the contact surface remains macroscopically flat. Therefore, in the course of subsequent switching no arc formation as a result of macroscopic uneveness is to be expected with the contact pieces in accordance with this invention.

The formation of cracks and pores is avoided because of the chromium columns, which only form small, point-like surfaces at the contact surface. Thermal and electrical conductivity is only slightly diminished by the thin layer of the switching texture being formed. Quicker thermal cooling leads to the formation of a finer structure in this switching texture layer and causes a reduced welding strength. The electrical current flows without hindrance, pores or cracks, and therefore at a homogeneous current density, on the direct path from the switching texture layer into the basic material, i.e. the contact piece. It can flow through the contact material along the copper paths almost unhindered, which is also proven by the increased electrical conductivity in the stretching direction. Consumption on the contact surface is low because of the switching texture layer formed as a barrier layer in the course of the employment of the contact piece, which leads to a clear increase in its useful life. The material bond of the contact material is increased because of the elongated chromium columns. On the one hand, there is sufficient chromium present at the surface for counteracting a welding process, but on the other hand the electrical current can flow along the direct paths of high conductivity through the contact material because of a sufficient amount of copper.

What is claimed is:

1. A method for producing a contact material made of copper and chromium in a proportion of 40 to 75 wt.-% copper and 25 to 60 wt.-% of chromium in a form of a semi-finished product, from which individual contact pieces are produced for use in vacuum switch devices, the method comprising the steps of:

pressing a chromium powder in an amount corresponding to a chromium content of the contact material to be produced into a porous chromium powder compact or pressing a mixture of the chromium powder in an amount corresponding to the chromium content of the contact material to be produced and of a copper powder in an amount which is less by 5 to 15 wt.-% with respect to a copper content of the contact material to be produced into a porous copper-chromium powder compact, using pressures between 200 and 1000 MPa, the porous compact having a density corresponding to 75 to 90% of a theoretical density;

covering the porous chromium powder compact or the porous copper-chromium powder compact with an amount of the copper which at least corresponds to a copper amount missing from the contact material to be produced;

thereafter, heating the chromium powder compact covered with copper or the porous copper-chromium powder compact covered with copper in a high vacuum to a temperature up to or above a melting point of the copper, wherein the compact is sintered, forming a chromium matrix sinter body or a copper-chromium matrix sinter body, and the chromium matrix sinter bodies or copper-chromium matrix sinter bodies being simultaneously infiltrated by the copper covering the compact, the copper being liquefied;

obtaining a copper-infiltrated chromium sinter body or a copper-infiltrated copper-chromium sinter body, the sinter body having a copper content increased in comparison with the compact and a density corresponding to 96 to 98% of the theoretical density;

subsequently forming the obtained copper-infiltrated chromium sinter body or the copper-infiltrated copper-chromium sinter body into a semi-finished product constituting the contact material by extrusion in a stretching direction, wherein chromium grains in the sinter bodies are pulled out in the stretching direction to form chromium columns and an elongated straightened structure, and wherein a shaping degree of the sinter bodies is at least 30%; and obtaining a semi-finished contact material product which has a straightened structure and a density which corresponds to at least 99%, in particular 99.5 to 99.9% of the theoretical density.

2. The method in accordance with claim 1, wherein the copper-infiltrated chromium sinter body or the copper-chromium sinter body is deformed one of cold and warm at a shaping degree which is at least 50%.

3. The method in accordance with claim 1, wherein a reshaping of the copper-infiltrated chromium sinter body or the copper-chromium sinter body is performed by one of extrusion, forging and rolling.

4. The method in accordance with claim 1, wherein an electrolytically obtained highly purified chromium powder of a degree of purity of 99.8% or higher is employed as the chromium powder.

5. The method in accordance with claim 1, wherein the chromium powder of a grain size greater than 50 $\mu$m and up to less than 160 $\mu$m is employed.

6. The method in accordance with claim 1, wherein the compacts which contain only chromium powder are covered with an amount of copper which is sufficient for producing a contact material with at least 50 wt.-% of chromium.

7. The method in accordance with claim 6, wherein contact pieces are cut off the semi-finished contact material product transversely to the stretching direction of the semi-finished product, so that a contact surface extends perpendicularly with respect to the stretching direction.

8. In a powder-metallurgical material for contact pieces for vacuum switch devices made of copper and chromium in a proportion of 40 to 75 wt.-% of copper and 25 to 60 wt.-% of chromium, the improvement comprising: the contact material having a density of at least 99% of a theoretical density and having a straightened structure obtained by one of cold and warm reshaping in one stretching direction, chromium powder particles reshaped into elongated chromium columns and embedded in elongated copper tracks, and electrical conductivity parallel with the stretching direction being at least 10% greater than perpendicularly with respect to the stretching direction, and the tensile strength parallel with the stretching direction being at least 10% greater than perpendicularly with respect to the stretching direction.

9. In the powder-metallurgical material in accordance with claim 8, having a content of 55 to 62 wt.-% of the copper, a shaping degree of at least 70%, and the electrical conductivity parallel with the stretching direction lies at 45% of the electrical conductivity of pure copper, and a tensile strength in the stretching direction is at least 550 $N/mm^2$.

10. In a contact piece for vacuum switch devices made of a powder-metallurgical material of copper and chromium in a proportion of 40 to 75 wt.-% of copper and 25 to 60 wt.-% of chromium, which is produced by fabricating a semi-finished product, the improvement comprising: a copper-infiltrated sinter body with one of a chromium matrix and a copper-chromium matrix reshaped one of cold and warm in one stretching direction by at least 30% and having a density corresponding to at least 99%, in particular greater than 99.4%, of a theoretical density, and having a contact surface formed transversely with respect to the stretching direction, and having a tensile strength and electrical conductivity parallel with the stretching direction are respectively greater by at least 10% than transversely to the stretching direction.

11. The method in accordance with claim 1, wherein contact pieces are cut off the semi-finished contact material product transversely to the stretching direction of the semi-finished product, so that a contact surface extends perpendicularly with respect to the stretching direction.

* * * * *